US009256233B2

(12) United States Patent
Mandal et al.

(10) Patent No.: US 9,256,233 B2
(45) Date of Patent: Feb. 9, 2016

(54) GENERATING A ROOT OF AN OPEN-LOOP FREQENCY RESPONSE THAT TRACKS AN OPPOSITE ROOT OF THE FREQUENCY RESPONSE

(71) Applicant: STMicroelectronics International N.V., Amsterdam (NL)

(72) Inventors: Pralay Mandal, Kolkata (IN); Sajal Kumar Mandal, Howrah (IN)

(73) Assignee: STMicroelectronics International N.V., Amsterdam (NL)

( * ) Notice: Subject to any disclaimer, the term of this patent is extended or adjusted under 35 U.S.C. 154(b) by 272 days.

(21) Appl. No.: 13/915,828

(22) Filed: Jun. 12, 2013

(65) Prior Publication Data

US 2014/0368176 A1 Dec. 18, 2014

(51) Int. Cl.
*G05F 1/575* (2006.01)
*G05F 1/445* (2006.01)

(52) U.S. Cl.
CPC ..... *G05F 1/445* (2013.01); *G05F 1/575* (2013.01)

(58) Field of Classification Search
CPC ..... G05F 1/565; G05F 1/575
USPC ..... 323/273, 275, 277, 280
See application file for complete search history.

(56) References Cited

U.S. PATENT DOCUMENTS

| | | | | |
|---|---|---|---|---|
| 6,300,749 | B1 | 10/2001 | Castelli et al. | |
| 6,603,292 | B1 | 8/2003 | Schouten et al. | |
| 6,765,374 | B1 | 7/2004 | Yang et al. | |
| 7,268,524 | B2 | 9/2007 | Kase et al. | |
| 7,728,569 | B1 | 6/2010 | Le et al. | |
| 7,902,801 | B2 | 3/2011 | Mandal | |
| 8,120,390 | B1 * | 2/2012 | Mack | 327/108 |
| 8,169,203 | B1 * | 5/2012 | Vemula | 323/273 |
| 2002/0093321 | A1 * | 7/2002 | Wrathall | 323/282 |
| 2006/0012356 | A1 * | 1/2006 | Kase et al. | 323/282 |
| 2007/0159146 | A1 * | 7/2007 | Mandal | 323/280 |
| 2011/0018510 | A1 | 1/2011 | Gao et al. | |
| 2014/0191739 | A1 * | 7/2014 | Kim et al. | 323/280 |
| 2014/0368176 | A1 * | 12/2014 | Mandal et al. | 323/280 |

OTHER PUBLICATIONS

Tsz-Fai Kwok, and Wing-Hung Ki, "A stable compensation scheme for low dropout regulator in the absence of ESR"; 33rd European Solid State Circuits Conference, 2007. ESSCIRC 2007; IEEE Conference Publications, pp. 416-419.

Ka Chun Kwok, and Mok, P.K.T., Pole-zero tracking frequency compensation for low dropout regulator, IEEE International Symposium on Circuits and Systems, 2002. ISCAS 2002; IEEE Conference Publications, pp. IV-735 to IV-738.

* cited by examiner

*Primary Examiner* — Jeffrey S Sterrett
(74) *Attorney, Agent, or Firm* — Gardere Wynne Sewell LLP

(57) ABSTRACT

In an embodiment, an electronic includes a feedback-coupled circuit stage and a compensation circuit stage. The feedback-coupled stage is configured to drive a load, and the compensation stage is coupled to the feedback-coupled stage such that a combination of the compensation and feedback-coupled stages has a frequency response including a first root and an opposite second root that depend on the load. For example, an embodiment of such an electronic circuit may be a low-dropout (LDO) voltage regulator that lacks a large output capacitance for forming a dominant pole to stabilize the regulator. The regulator includes a feedback-coupled stage that generates and regulates an output voltage, and includes a compensation stage that is designed such that the frequency response of the regulator includes a zero that tracks a non-dominant output pole of the regulator so that the output pole does not adversely affect the stability of the regulator.

20 Claims, 7 Drawing Sheets

GENERATING A ROOT OF AN OPEN-LOOP FREQENCY RESPONSE THAT TRACKS AN OPPOSITE ROOT OF THE FREQUENCY RESPONSE

SUMMARY

In an embodiment, an electronic circuit includes a feedback-coupled stage and a compensation stage. The feedback-coupled stage is configured to drive a load, and the compensation stage is coupled to the feedback-coupled stage such that the circuit, which is a combination of the compensation and feedback-coupled stages, has a transfer function, i.e., a frequency response, including a first root and an opposite second root that depend on the load.

An embodiment of such an electronic circuit may be a low-drop-out (LDO) voltage regulator that lacks a large output capacitance for forming a dominant pole to stabilize the regulator; for example, such an LDO voltage regulator may be an on-chip circuit that generates a voltage for one of multiple separate voltage islands inside a system on a chip (SOC), where including such a large output capacitance may be impractical. The LDO regulator includes a feedback-coupled stage that generates and regulates an output voltage, and includes a compensation stage that imparts to the frequency response of the regulator a zero that tracks a non-dominant output pole of the regulator's frequency response so that the output pole does not degrade the stability of the regulator, particularly at lighter loads that draw lower load currents. Furthermore, the compensation stage may also impart to the frequency response of the regulator a dominant pole that stays within a relatively small frequency range over a relatively large range of load levels.

DETAILED DESCRIPTION

Figure 1:
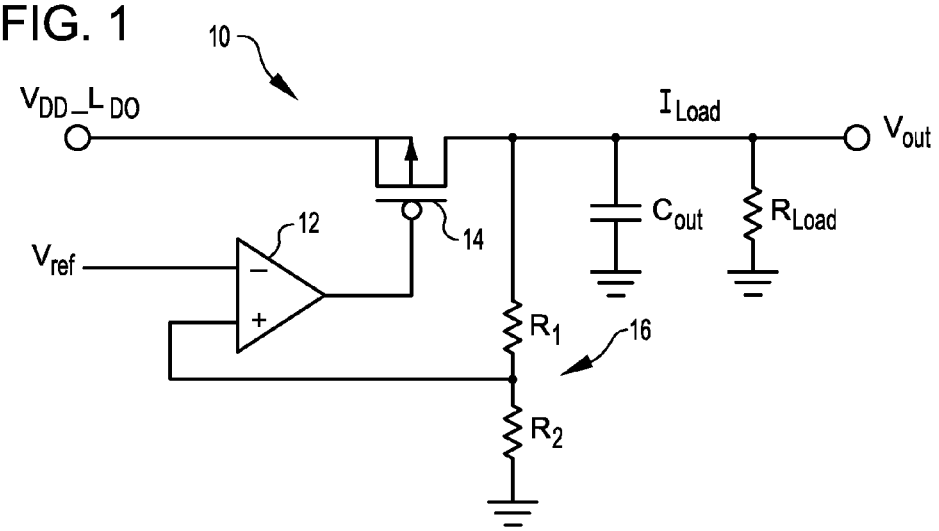
FIG. 1 is a diagram of a LDO voltage regulator.

FIG. 1 is a schematic diagram of a LDO voltage regulator 10, which is configured to provide a regulated output voltage $V_{out}$ to a load, which is modeled as a resistor $R_{Load}$. Although the load may be described as being a resistive load $R_{Load}$, the load may also have a reactive component such as a capacitive component $C_{out}$ as shown in FIG. 1. $C_{out}$ may represent only the capacitance of the load, or it may represent the combination of the load capacitance and a separate output capacitance that is in parallel with the load.

The LDO regulator 10 includes a high-gain amplifier 12, a PMOS pass transistor 14, a voltage divider 16 including resistors $R_1$ and $R_2$, and an output capacitor $C_{out}$—if the load has a capacitive component, then the capacitance of this component may be accounted for in the value of $C_{out}$ as described above. The amplifier 12 includes an inverting node "–" coupled to receive a stable (e.g., a band-gap) reference voltage $V_{ref}$, and includes a non-inverting node "+" coupled to receive a feedback voltage $V_{FB}$ from the junction of the resistors $R_1$ and $R_2$. The PMOS transistor 14 has a source coupled to receive an input voltage $V_{DD_LDO}$, a drain coupled to provide $V_{out}$, and a gate coupled to the output node of the amplifier 12.

In operation, the amplifier 12 controls the conductance of the PMOS pass transistor 14 so as to regulate $V_{out}$ to a particular voltage (e.g., 1.3 Volts (V)) by maintaining $V_{FB}$ equal to $V_{ref}$, at least within a tolerance dictated, at least in part, by the input offset error and gain of the amplifier. Because the PMOS transistor 14 can conduct a current even while its source-drain voltage is relatively low, the regulator 10 can generate $V_{out}$ to have a magnitude that is almost equal to the magnitude of $V_{DD_LDO}$. For example, depending on the value of the effective load resistance $R_{Load}$, and, therefore, depending on the level of the load current $I_{LOAD}$, the regulator 10 may be able to generate $V_{out}$=1.3 V from a value of $V_{DD_LDO}$ as low as 1.4 V. That is, the regulator 10 can operate properly even when the "head room" between $V_{DD_LDO}$ and $V_{out}$ is relatively low; hence, the term "low-drop-out regulator." Consequently, the LDO regulator 10 may be best suited for applications in which the difference between $V_{DD_LDO}$ and $V_{out}$ is 1.0 V or less.

Still referring to FIG. 1, the output capacitor $C_{out}$ typically serves at least two functions.

A first function of $C_{out}$ is to act as a bypass capacitor that can filter step changes in the load current $I_{Load}$. For example, $C_{out}$ may provide an "injection" of current in response to a step, or otherwise sudden, increase in the load current $I_{Load}$ until the regulation feedback loop, which includes of the voltage divider 16, the amplifier 12, and the PMOS transistor 14, responds to this increase by increasing the current through the PMOS transistor. For example, where the load is a microprocessor, such a step increase in $I_{Load}$ may be caused by the microprocessor transitioning from a "sleep" mode to an "awake" mode. Similarly, $C_{out}$ may absorb an injection of current in response to a step, or otherwise sudden, decrease in $I_{Load}$ until the regulation feedback loop responds to this decrease by decreasing the current through the PMOS transistor. For example, where the load is a microprocessor, such a step decrease in $I_{Load}$ may be caused by the microprocessor transitioning from an "awake" mode to a "sleep" mode.

And a second function of $C_{out}$ is to form a lowest, i.e., dominant, pole of the regulator's frequency response such that the LDO regulator 10 is stable (i.e., does not oscillate or generate excessive "ringing" on the output voltage $V_{out}$). That is, in general, $C_{out}$, along with $R_{Load}$, $R_1$, $R_2$, and the output resistance and output conductance of the PMOS transistor 14, form a pole that is low enough in frequency such that the open-loop gain of the LDO regulator 10 is less than unity at frequencies at which the open-loop phase of the LDO regulator is greater than or equal to 180°, and such that the open-loop phase of the LDO regulator is less than 180° at frequencies at which the open-loop gain of the LDO regulator is greater than or equal to unity. Although the frequency of this dominant pole may shift with changes in $R_{LOAD}$, and, therefore, with changes in $I_{LOAD}$, a circuit designer typically makes $C_{OUT}$ large enough, and, therefore, makes the dominant pole small enough, so that the LDO regulator 10 remains stable even when such load-induced shifts in the dominant pole's frequency occur.

A value of capacitance that allows $C_{out}$ to serve both of the above-described first and second functions, at least in some applications, is a value that lies within an approximate range of 100 nanofarads (nF)-10 microfarads (μF).

But unfortunately, as described below in conjunction with FIG. 2, having a capacitance value within this range may render $C_{out}$ unsuitable for at least some other applications.

Figure 2:
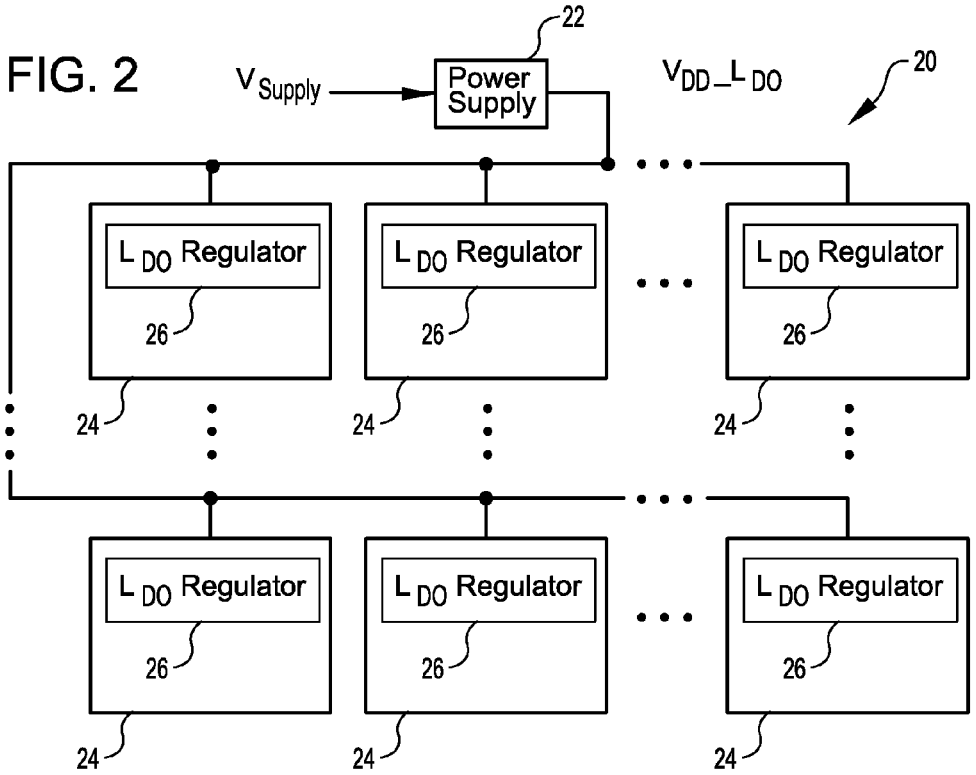
FIG. 2 is a diagram of a system that includes circuit islands each having a respective LDO voltage regulator, according to an embodiment.

FIG. 2 is a block diagram of a system on a chip (SOC) 20, according to an embodiment.

The SOC 20 includes a main power supply 22, circuit islands (also called "power islands" or "voltage islands") 24, and LDO voltage regulators 26. The main power supply 22 may include a conventional power supply, such as a multiphase switching power supply.

In operation, the main power supply 22 receives an external supply voltage $V_{supply}$, and generates therefrom a regulated internal supply voltage $V_{DD_LDO}$. For example, $V_{supply}$ may equal 5.0 V, and $V_{DD_LDO}$ may equal 1.80 V.

Each LDO voltage regulator 26 converts $V_{DD_LDO}$ into a respective supply voltage for the respective circuit island 24 on which the LDO regulator is located. For example, $V_{DD_LDO}$ may equal 1.80 V, and one or more of the LDO voltage regulators 26 may each convert $V_{DD_LDO}$ into a respective island supply voltage equal to 1.30 V.

Because there are multiple LDO voltage regulators 26 on the SOC 20, it typically would be impractical or impossible to include, on the SOC, a respective output capacitor having the size (e.g., 100 nF-10 μF) of the output capacitor $C_{out}$ of FIG. 1 for each LDO regulator. Reasons for this include that it may be difficult to integrate on an integrated circuit capacitors having such a large capacitance, and, that even if one could integrate such capacitors, the SOC 20 may be too small to include such an integrated capacitor for each circuit island 24.

Furthermore, it may be impractical to include such output capacitors on a printed circuit board to which the SOC 20 is mounted, because the board may not have enough room to accommodate a respective output capacitor for each LDO voltage regulator 26.

Therefore, there is a need for a circuit topology that allows stabilizing a feedback-coupled circuit (or circuit stage), such as an LDO voltage regulator, over a relatively large range of load levels without a relatively large output capacitor.

Figure 3:
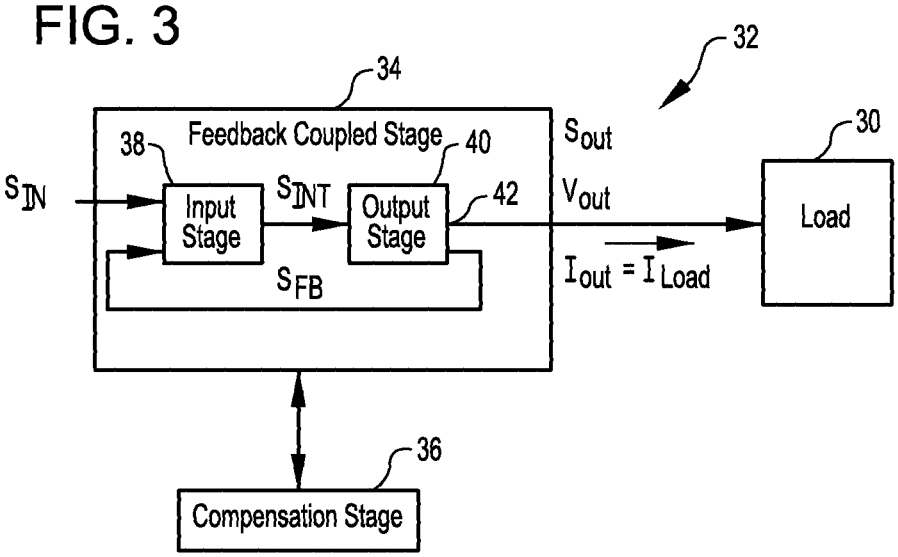
FIG. 3 is a diagram of a load, and of a circuit that includes a feedback-coupled stage configured to drive the load and a compensation stage configured to stabilize the circuit, according to an embodiment.

FIG. 3 is a diagram of a load 30 and a circuit 32 for providing a signal $S_{out}$ to the load, where the circuit stable over a relatively large range of load levels without the presence of a relatively large output capacitor.

The circuit 32 includes a feedback-coupled stage 34 and a compensation stage 36 coupled to the feedback-coupled stage; that is, the circuit 32 may be considered to be a combination of the feedback-coupled and compensation stages.

The feedback-coupled stage 34 includes an input stage 38 and an output stage 40. The input stage 38 is configured to receive an input signal $S_{IN}$ and a feedback signal $S_{FB}$, and to generate an intermediate signal $S_{INT}$ in response to $S_{IN}$ and $S_{FB}$. For example, the input stage 38 may include a high-gain differential amplifier (not shown in FIG. 3) that generates $S_{INT}$ so as to cause $S_{FB}$ to approximately equal $S_{IN}$. The output stage 40 is configured to receive $S_{INT}$ from the input stage 38, and to generate $S_{FB}$ and an output signal $S_{OUT}$, which has a voltage component $V_{OUT}$ and a current component $I_{OUT}$—although not shown in FIG. 3, the other signals $S_{IN}$, $S_{INT}$, and $S_{FB}$ also have respective voltage and current components. Although $I_{OUT}$ is shown as being equal to $I_{LOAD}$, in another embodiment $I_{OUT}$ may not be equal to $I_{LOAD}$.

Because the feedback-coupled stage 34 includes a negative-feedback topology in which the output stage 40 feeds back the signal $S_{FB}$ to the input stage 38, the feedback-coupled stage may be unstable if the input and output stages are not frequency compensated properly. Such instability may manifest itself, for example, in "ringing" (i.e., damped oscillations) superimposed on $V_{OUT}$, or in oscillation of $V_{OUT}$.

Because a pole or a zero of the feedback-coupled stage 34 may change as the load 30 changes, proper frequency compensation should encompass at least the entire anticipated range of the load for a particular application.

For example, as described above in conjunction with FIG. 2, when it is an output pole that may change as the load 30 changes, one way to provide such proper frequency compensation is to include a large output capacitor at an output node 42 of the output stage 40.

But as also described above, a large output capacitor may be unsuitable for some applications of the feedback-coupled stage 34, such as an application in which multiple feedback-coupled stages are integrated on a single integrated-circuit die.

Therefore, the compensation stage 36 is added to the circuit 32, and is configured to impart proper frequency compensation to the circuit throughout the entire anticipated range of the load 30 without a large output capacitor.

For purposes of explanation, assume that the circuit 32 has a transfer function, i.e., a frequency response, that includes a dominant, lower-frequency pole that, by itself, would cause the circuit to operate stably, and that includes an output pole that is at a higher frequency than the dominant pole but that is dependent on, i.e., shifts with changes in, the load 30; for example, the output pole may increase as the load current $I_{LOAD}$ increases, and may decrease as $I_{LOAD}$ decreases. Therefore, at one or more levels of the load 30, the output pole may be close enough to the dominant pole to cause the circuit 32 to be unstable. For example, at relatively low levels of the load current $I_{LOAD}$, the load-current-dependent output pole may be close enough to the dominant pole to cause the open-loop phase shift of the circuit 32 to equal or exceed 180° while the open-loop gain of the circuit is greater than or equal to unity, thus causing the circuit to oscillate. But even if the output pole does not cause the open-loop phase shift to equal or exceed 180° while the open-loop gain is greater than or equal to unity, the output pole may still be close enough to the dominant pole to cause ringing on $V_{OUT}$. And even if the output pole does not cause $V_{OUT}$ to ring, it may reduce the phase margin or gain margin of the circuit 32 to a level that puts the circuit in danger of becoming unstable if one or more other parameters (e.g., temperature, process, voltage) differ from their nominal values.

But the compensation stage 36 stabilizes the circuit 32 by introducing a zero to the circuit's frequency response, where the zero tracks and fully cancels the output pole, or tracks and at least mitigates the negative affect that the output pole would otherwise have on the dominant pole as described in the preceding paragraph. It is known that if a circuit has a frequency response with a pole and a zero at the same frequency, then the pole and zero fully cancel each other such that it is as if the frequency response has neither a pole nor a zero at the frequency. But even if the pole and zero are not at exactly the same frequency, then the pole and zero may partially cancel each other if their frequencies are relatively close to each other. Therefore, the zero that the compensation stage 36 introduces into the frequency response of the circuit 32 may track the output pole exactly so as to fully cancel the output pole, or may track the output pole inexactly, but closely enough such that the output pole does not cause the circuit to be unstable for at least any level of the load 30 that falls within an anticipated range load levels.

Still referring to FIG. 3, in more general terms, because a pole and a zero are roots of the denominator and numerator, respectively, of a characteristic equation that represents the frequency response of the circuit 32, it can be said that the compensation stage 36 is configured to introduce into the circuit's frequency response a first numerator or denominator root that tracks, and partially or fully cancels, a second denominator or numerator root so as to stabilize the circuit over a range of at least one variable parameter (e.g., a load) on which the second root depends. That is, the compensation stage 36 may introduce into the frequency response of the circuit 32 a zero that tracks, and that partially or fully cancels, a pole that depends on a varying parameter, or may introduce into the frequency response a pole that tracks, and that partially or fully cancels, a zero that depends on a varying parameter. At least for purposes of this disclosure, a numerator root (i.e., a zero) may be referred to as being an "opposite" (or another form or a synonym of "opposite") root to a denominator root (i.e., a pole), and a denominator root (i.e., a pole) may be referred to as being an "opposite" (or another form or a synonym of "opposite") root to a numerator root (i.e., a zero). That is, for example, "a first root and an opposite second root" may refer to a first root that is a pole and a second root that is a zero, or to a first root that is a zero and a second root that is a pole. And, for example, "a first root and a second root" may refer to a first root that is a zero and a second root that is a zero, to a first root that is a zero and a second root that is a pole, to a first root that is a pole and a second root that is a zero, and to a first root that is a pole and a second root that is a pole.

Consequently, the compensation stage 36 may be added to any feedback-coupled stage, such as the feedback-coupled stage 34, to form a feedback-coupled circuit in which a root of the circuit's frequency response is tracked, and partially or fully cancelled, by an opposite root of the circuit's frequency response so as to stabilize the circuit or to impart another characteristic to the circuit.

Still referring to FIG. 3, other embodiments of the feedback-coupled circuit 32 are contemplated. For example, the feedback-coupled stage 34 may include stages in addition to, or in place of, one or both of the input and output stages 38 and 40. Furthermore, the compensation stage 36 may be coupled to the feedback-coupled stage 34 in a manner other than the manner described.

Figure 4:
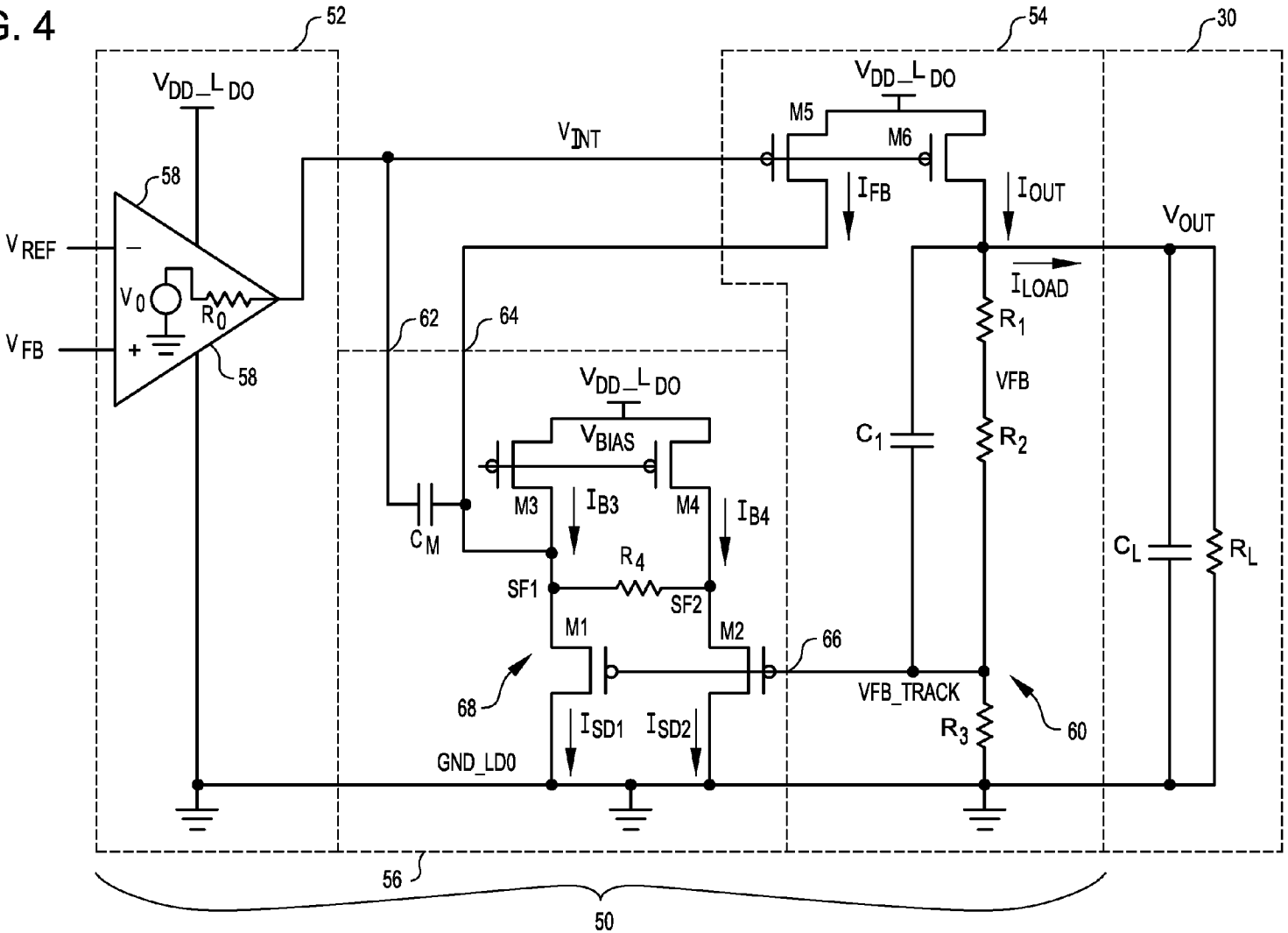
FIG. 4 is a schematic diagram of a load, and of a LDO voltage regulator that is an implementation of the circuit of FIG. 3 and that is configured to provide a regulated supply voltage to the load, according to an embodiment.

FIG. 4 is a schematic diagram of an embodiment of the load 30 and of the feedback-coupled circuit 32 of FIG. 3; in the described embodiment, the feedback-coupled circuit is a LDO voltage regulator 50 that includes no large output capacitor but that is stable over a range of anticipated levels of the load. The regulator 50 may be formed from discrete components, integrated by itself on an integrated-circuit die, or integrated with other LDO voltage regulators or other circuits on an integrated-circuit die.

In addition to the load 30, which is modeled as a parallel combination of a load resistance $R_L$ and a load capacitance $C_L$, the LDO voltage regulator 50 includes an input stage 52, an output stage 54, and a compensation stage 56.

The input stage 52 includes a high-gain differential amplifier 58, such as an operational amplifier, that includes an output resistance $R_o$, that is configured to receive a reference voltage $V_{REF}$ and a feedback voltage $V_{FB}$, and that is configured to generate an intermediate voltage $V_{INT}$.

The output stage 54 includes a drive transistor $M_6$ that is configured to generate a current $I_{OUT}$ in response to the voltage $V_{INT}$, a mirror transistor $M_5$ that is configured to generate a feedback current $I_{FB}$, a compensation capacitor $C_1$, and a voltage divider 60 that includes series-coupled resistors $R_1$, $R_2$, and $R_3$, which are configured to generate the feedback voltage $V_{FB}$ and another feedback voltage $V_{FB_TRACK}$.

The compensation stage 56 includes a first node 62 configured to receive the voltage $V_{INT}$, a second node 64 configured to receive the feedback current $I_{FB}$, a third node 66 configured to receive the feedback voltage $V_{FB_TRACK}$, a compensation capacitor $C_M$ coupled between the first and second nodes, and a network 68 that is configured to provide a variable resistance that tracks the load resistance $R_L$. As further described below, the capacitor $C_M$ and the variable resistance form a zero that tracks, and at least partially cancels, an output pole of the LDO voltage regulator 50. Furthermore, as described below, the capacitor $C_M$ is also a factor in the dominant pole of the LDO voltage regulator 50.

The network 68 of the compensation stage 56 includes PMOS bias transistors $M_3$ and $M_4$, variable-transconductance PMOS transistors $M_1$ and $M_2$, which have their sources respectively coupled to the drains of the transistors $M_3$ and $M_4$ and their gates coupled to the third node 66, and a resistor $R_4$ coupled between the sources of the transistors $M_3$ and $M_4$.

Figure 5:
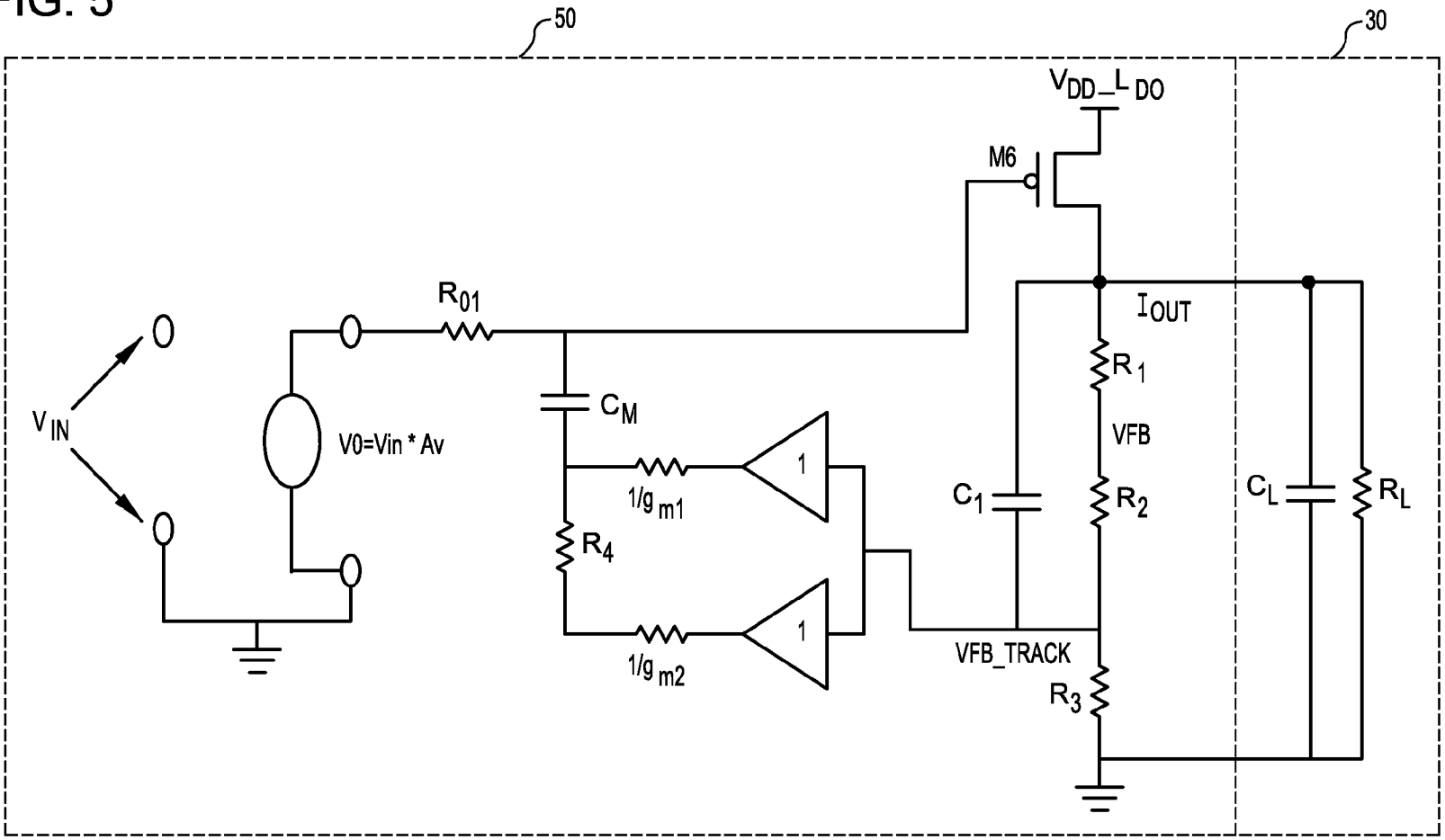
FIG. 5 is a circuit model of the load and of the LDO voltage regulator of FIG. 4, according to an embodiment.

FIG. 5 is a diagram of a simplified circuit model of the load 30 and of the LDO voltage regulator 50 of FIG. 4.

The steady-state and output-root-tracking operations of the LDO voltage regulator 50 are now described in conjunction with FIGS. 4 and 5, where the root that is tracked is an output pole of the LDO regulator, and the opposite root that tracks the output pole is a zero of the LDO regulator.

During steady-state operation, the amplifier 58 generates the voltage $V_{INT}$, which causes the transistor $M_6$ to source the current $I_{OUT}$.

A first portion of the current $I_{OUT}$ is the current $I_{LOAD}$, which powers the load 30, and a second portion of the current $I_{OUT}$ flows through the voltage divider 60, which generates the feedback voltage $V_{FB}$ according to the following equation:

$$V_{FB} = V_{OUT} \cdot \frac{R_2 + R_3}{R_1 + R_2 + R_3} \tag{1}$$

The amplifier 58 receives $V_{FB}$ at its non-inverting input node, and generates $V_{INT}$ such that $V_{FB}$ equals (within the error tolerance of the amplifier) $V_{REF}$, which the amplifier receives at its inverting input node and which is a stable reference voltage such as generated by a band gap voltage generator (not shown in FIGS. 4 and 5).

But as described above in conjunction with FIG. 3, as the load resistance $R_L$ changes (e.g., due to the load 30 "waking up" or "falling asleep"), an output pole $P_{OUT}$ of the frequency response of the LDO voltage regulator 50 may change, and thus may cause the LDO regulator to become unstable such that, for example, $V_{OUT}$ exhibits ringing in response to transient changes in $R_L$, or, in an extreme case, exhibits oscillation.

To prevent the LDO voltage regulator 50 from becoming unstable, the compensation stage 56 causes the regulator's frequency response to include a zero $Z_{TRACK}$ that tracks, and partially or fully cancels, the output pole $P_{OUT}$.

The output pole $P_{OUT}$ increases as the load resistance $R_L$ decreases and, therefore, as the load current $I_{LOAD}$ increases, and $P_{OUT}$ decreases as $R_L$ increases and, therefore, as $I_{LOAD}$ decreases; therefore, the output pole $P_{OUT}$ is proportional to $I_{LOAD}$ and is inversely proportional to $R_L$.

The network 68 of the compensation circuit 56 receives, via the node 64, the feedback current $I_{FB}$, which is given by the following equation:

$$I_{FB}=K_1 \cdot I_{OUT} \tag{2}$$

$K_1$ of equation (2) is a constant that is, in an embodiment, less than one, and that is given by the following equation:

$$K_1 = \frac{\frac{W_5}{L_5}}{\frac{W_6}{L_6}} \tag{3}$$

where $$\frac{W_5}{L_5}$$

is the width-to-length ratio of the transistor $M_5$, and $$\frac{W_6}{L_6}$$

is the width-to-length ratio of the transistor $M_6$. Because $I_{FB}$ is proportional to $I_{OUT}$ per equation (2), and because $I_{OUT}$ is proportional to $I_{LOAD}$ and is inversely proportional to $R_L$, then $I_{FB}$ is also proportional to $I_{LOAD}$ and inversely proportional to $R_L$.

In response to a bias voltage $V_{BIAS}$, the bias transistor $M_3$ of the network 68 generates a bias current $I_{B3}$ that flows through, and biases, the transistor $M_1$; likewise, in response to $V_{BIAS}$, the bias transistor $M_4$ generates a bias current $I_{B4}$ that flows through, and biases, the transistor $M_2$. In an embodiment, the width-to-length ratio of $M_4$ is less than the width-to-length ratio of $M_3$ such that $I_{B3}>I_{B4}$.

And, as further described below, the transconductance $g_{m1}$ of the transistor $M_1$ is proportional to the source-to-drain current $I_{SD1}$ that flows through the transistor $M_1$; likewise, the transconductance $g_{m2}$ of the transistor $M_2$ is proportional to the source-to-drain current $I_{SD2}$ that flows through the transistor $M_2$. In an embodiment, the width-to-length ratio of the transistor $M_1$ is greater than the width-to-length ratio of the transistor $M_2$ such that $I_{SD1}>I_{SD2}$.

Because a first portion of the feedback current $I_{FB}$ flows through the transistor $M_1$ such that this first portion of $I_{FB}$ is a component of the current $I_{SD1}$, and because $g_{m1}$ is proportional to $I_{SD1}$, the transconductance $g_{m1}$ of $M_1$ is proportional to $I_{FB}$, and is, therefore, proportional to $I_{LOAD}$ and inversely proportional to $R_L$.

Furthermore, because $1/g_{m1}$ has units of ohms (Ω), the transistor $M_1$ effectively functions as a variable resistance $R_{m1}$ that is proportional to the effective load resistance $R_L$. That is, as $R_L$ increases, $R_{m1}$ increases, and as $R_L$ decreases, $R_{m1}$ decreases.

Similarly, because a second portion of the feedback current $I_{FB}$ flows through the resistor $R_4$ and the transistor $M_2$ such that this second portion of $I_{FB}$ is a component of the current $I_{SD2}$, and because $g_{m2}$ is proportional to $I_{SD2}$, the transconductance $g_{m2}$ of the transistor $M_2$ is proportional to $I_{FB}$, and is, therefore, proportional to $I_{LOAD}$ and inversely proportional to $R_L$.

Furthermore, because $1/g_{m2}$ has units of Ω, the transistor $M_2$ also effectively functions as a variable resistance $R_{m2}$ that is proportional to $R_L$.

Moreover, because the width-to-length ratio of the transistor $M_2$ is less than the width-to-length ratio of the transistor $M_1$, the first portion of $I_{FB}$ that flows through the transistor $M_1$ is greater than the second portion of $I_{FB}$ that flows through the resistor $R_4$ and the transistor $M_2$; therefore, for $I_{FB}>0$, $g_{m1}$ of $M_1$ is greater than $g_{m2}$ of $M_2$, and, therefore, $R_{m1}$ of $M_1$ is less than $R_{m2}$ of $M_2$.

Consequently, the network 68 can be modeled as a variable resistance that is coupled between the node 64 and ground such that this variable resistance and the capacitor $C_M$ form the zero $Z_{TRACK}$ that tracks, and partially or fully cancels, the output pole $P_{OUT}$ of the LDO regulator's frequency response. As described above, the frequency of the output pole $P_{OUT}$ increases as the load current $I_{LOAD}$ increases and the effective load resistance $R_L$ decreases, and $P_{OUT}$ decreases as $I_{LOAD}$ decreases and $R_L$ increases. Also as described above, the effective resistance $R_{m1}$ of the transistor $M_1$ and the effective resistance $R_{m2}$ of the transistor $M_2$ also decrease as $I_{LOAD}$ increases and $R_L$ decreases. Consequently, the frequency of the zero $Z_{TRACK}$ formed by the capacitor $C_M$ and the network 68 also increases as the frequency of the output pole $P_{OUT}$ increases, and decreases as $P_{OUT}$ decreases, such that $Z_{TRACK}$ tracks $P_{OUT}$. By selecting appropriate values for the width-to-length ratios $$\frac{W_1}{L_1}, \frac{W_2}{L_2}, \frac{W_3}{L_3}, \frac{W_4}{L_4}, \frac{W_5}{L_5}, \text{ and } \frac{W_6}{L_6},$$

and the resistors $R_1$, $R_2$, $R_3$, and $R_4$, a designer of the LDO voltage regulator 50 can design the zero $Z_{TRACK}$ to fully cancel the output pole $P_{OUT}$, or to partially cancel $P_{OUT}$ to a desired degree.

Furthermore, the network 68 may be designed such that at lower values of $I_{LOAD}$ (and, therefore, at higher values of $R_L$), the effective resistances $R_{m1}$ and $R_{m2}$ of the transistors $M_1$ and $M_2$ are relatively high such that $R_4$ is the dominating resistance factor in the tracking zero $Z_{TRACK}$. If the LDO voltage regulator 50 is integrated on a die and resistors $R_1$, $R_2$, $R_3$, and $R_4$ are polysilicon resistors, then this design strategy allows $R_4$ to track $R_1$, $R_2$, and $R_3$ over process, temperature, and voltage variations that may affect the values of these resistors when $I_{LOAD}$ is relatively low.

And the network 68 may also be designed such that at higher values of $I_{LOAD}$ (and, therefore, at lower values of $R_L$), the effective resistance $R_{m1}$ of the transistor $M_1$ is the dominant factor in the tracking zero $Z_{TRACK}$ such that $Z_{TRACK}$ increases as the output pole $P_{OUT}$ increases, and decreases as $P_{OUT}$ decreases, as described above.

Figure 6:
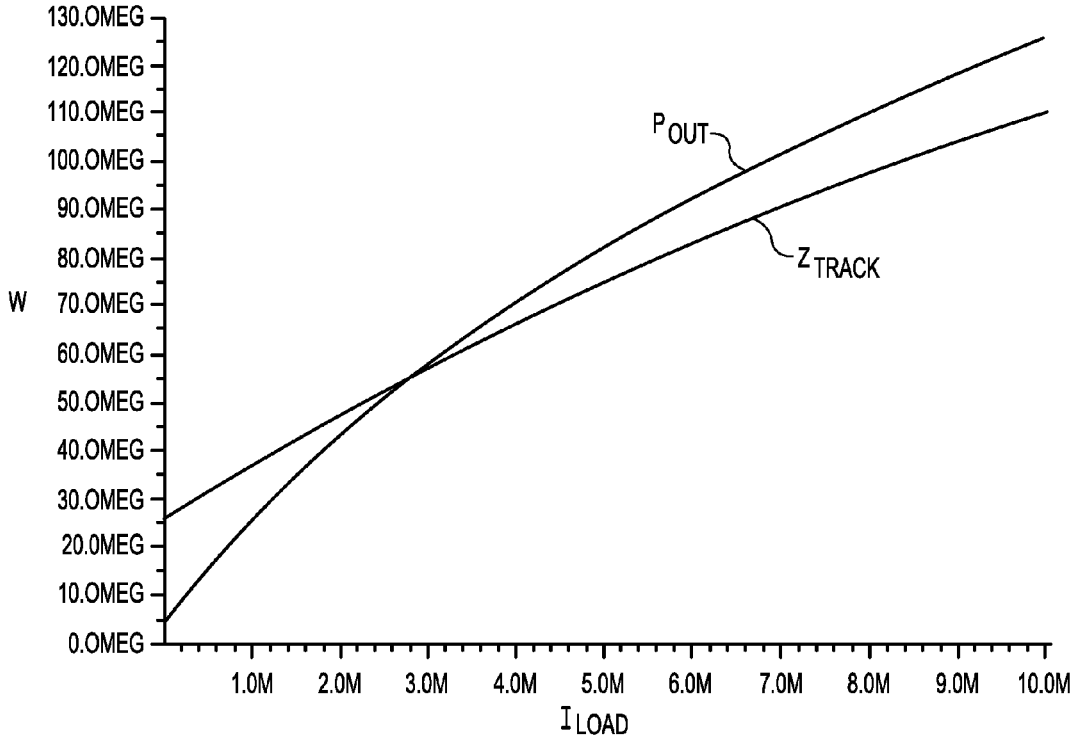
FIG. 6 is a plot of the output pole and the tracking zero of the LDO voltage regulator of FIG. 4 versus frequency, according to an embodiment.

FIG. 6 is a plot of the frequencies of output pole $P_{OUT}$ and of the tracking zero $Z_{TRACK}$ of the LDO voltage regulator 50 of FIGS. 4 and 5, according to an embodiment. The plot shows that the zero $Z_{TRACK}$ tracks the output pole $P_{OUT}$ over a relatively wide range of load current, from about $I_{LOAD}=0$ milliamperes (mA) to at least about $I_{LOAD}=10$ mA.

Referring again to FIGS. 4 and 5, the compensation stage 56 may also cause the frequency response of the LDO voltage regulator 50 to have a dominant pole $P_{DOMINANT}$ having a frequency that is lower than the frequency of $P_{OUT}$ and that is relatively constant over a relatively wide range of $I_{LOAD}$; $P_{DOMINANT}$ having a relatively constant frequency over the anticipated range of $I_{LOAD}$ allows the frequency response of the LDO regulator also to be relatively constant over this same range of $I_{LOAD}$. In more detail, the capacitor $C_M$ is the predominant capacitance in the pole $P_{DOMINANT}$, and forms $P_{DOMINANT}$ in conjunction with a combination of the following resistances: the output resistance $R_o$ of the amplifier 58, the resistors $R_1$, $R_2$, and $R_3$, the inverse of the transconductance $g_{m6}$ of the transistor $M_6$, the drain-to-source resistance $rds_6$ (not shown in FIGS. 4 and 5) of the transistor $M_6$, and the load resistance $R_L$; the capacitor $C_M$ is effectively coupled to the resistors $R_1$, $R_2$, and $R_3$, the transistor $M_6$, and the load resistance $R_L$ through the source-gate junction of the transistor $M_1$ because $M_1$ is configured as a source follower.

A reason that $P_{DOMINANT}$ is relatively constant over a relatively wide range of $I_{LOAD}$ is as follows. At relatively low and moderate levels of $I_{LOAD}$, $g_{m6}$, $R_o$, and $C_M$ increase as $I_{LOAD}$ increases. The increase in $g_{m6}$ is due to the increase in $I_{OUT}$ as described above, the increase in $R_o$ is because the PMOS output pull-up transistor (not shown in FIGS. 4 and 5) of the amplifier 58 starts operating in its saturation region, and the increase in $C_M$, which is a poly-N-well capacitor in an embodiment, is due to $C_M$ operating deeper within its accumulation region. But the load resistance $R_L$ decreases with increasing $I_{LOAD}$ at about the same combined rate as $g_{m6}$, $R_o$, and $C_M$ increase so that the net change in the frequency of the dominant pole $P_{DOMINANT}$ is approximately zero. As $I_{LOAD}$ continues to increase from a relatively moderate level to a relatively high level, however, the dominant pole $P_{DOMINANT}$ begins to increase relatively slightly, because as the PMOS output pull-up transistor of the amplifier 58 enters into its deep saturation region, the value of $R_o$ levels off such that the rate at which $R_L$ decreases outpaces the combined rate at which $g_{m6}$ and $C_M$ increase.

Figure 7:
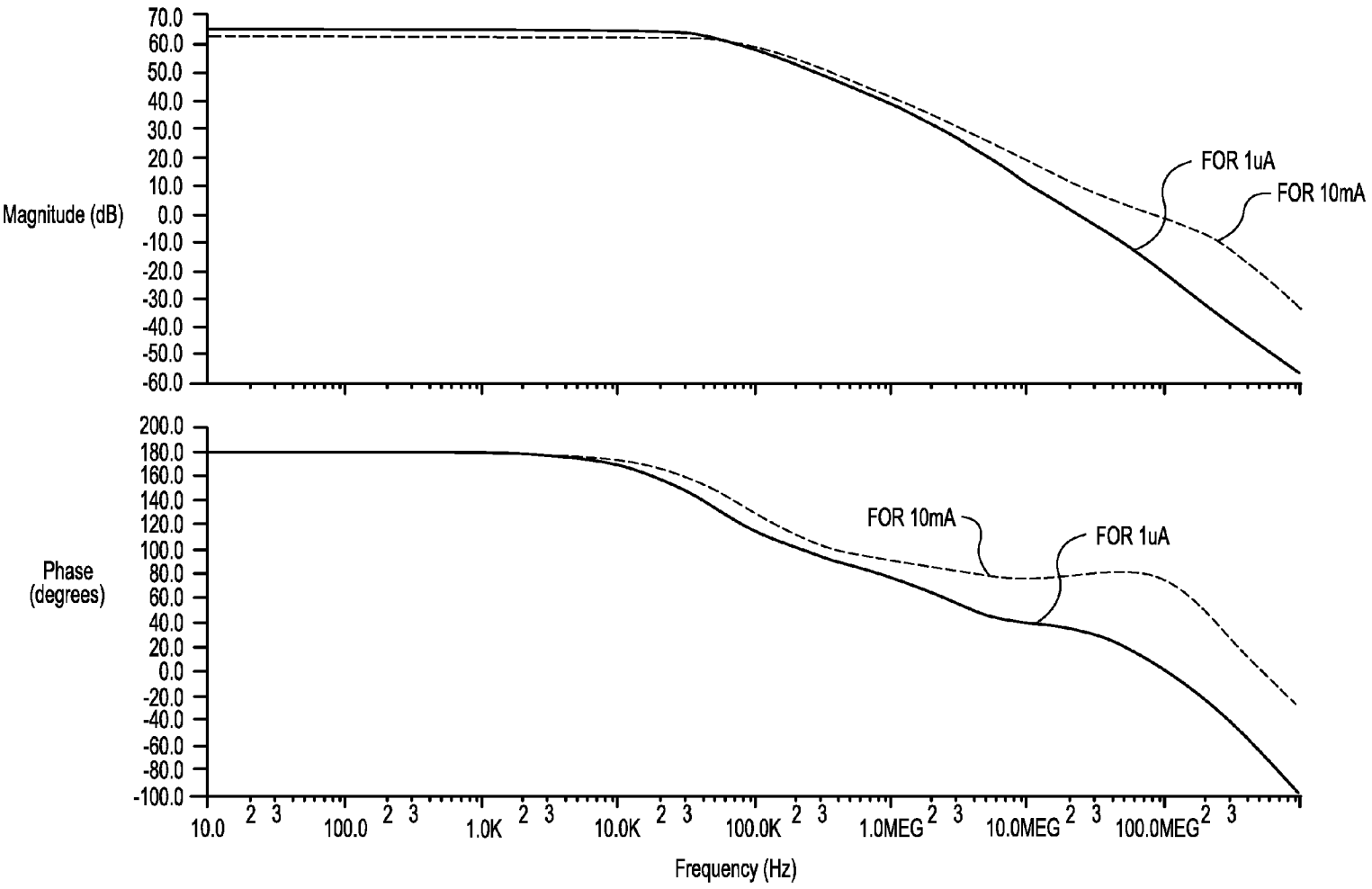
FIG. 7 is a Bode plot of the open-loop magnitude and phase of the LDO voltage regulator of FIG. 4 at two different load currents, according to an embodiment.

FIG. 7 is a plot of the open-loop frequency response (magnitude and phase) of the LDO voltage regulator 50 of FIGS. 4 and 5 for $I_{LOAD}$=1.0 μA and $I_{LOAD}$=10.0 mA, according to an embodiment. At frequencies above about 100 KHz, the magnitude of the open-loop frequency response is slightly greater at $I_{LOAD}$=10.0 mA than at $I_{LOAD}$=1.0 μA because, as described above in conjunction with FIGS. 4 and 5, the frequency of the dominant pole $P_{DOMINANT}$ increases at higher values of $I_{LOAD}$.

Referring again to FIGS. 4 and 5, the LDO voltage regulator 50 may also have a power-supply-rejection ratio (PSRR) and a load-transient step response that are suitable for many applications, and that are as good, or better, than the PSSRs and load-transient step responses of conventional LDO voltage regulators.

Still referring to FIGS. 4 and 5, now provided is a more rigorous mathematical explanation of the frequency response of the LDO voltage regulator 50, and of components of the frequency response such as the dominant pole $P_{DOMINANT}$, the output pole $P_{OUT}$, and the zero $Z_{TRACK}$ that tracks, and that partially or fully cancels the effects of, $P_{OUT}$.

The open-loop transfer function (in the Laplace Transform, i.e., "s", domain) of the LDO voltage regulator 50 is given by the following equation:

$$\frac{VOUT(S)}{VIN(S)} = \frac{A_V g_{m6} R_L \left[ \frac{SC_M}{g_{m1} \frac{1}{R_4 + 1/g_{m2}}} + 1 \right]}{S^2 \left[ R_3' R_0 R_{EQ} g_{m6} C_M C_1 + R_{EQ} R_0 (C_L + C_1) C_M + \frac{R_{EQ}(1 + g_{m2} R_4)(C_L + C_1) C_M}{G_1} \right] + S \left[ \frac{(1 + R_4 g_{m2}) C_M}{G_1} + R_{EQ}(C_L + C_1) + R_0 C_M + \frac{R_3}{R_1 + R_2 + R_3} g_{m6} R_{EQ} R_0 C_M \right] + 1} \tag{4}$$

where each variable (e.g., $C_M$, $C_1$, $R_o$, $R_1$-$R_4$, $g_{m1}$, $g_{m2}$, $g_{m6}$, and $rds_6$) represents the value of the corresponding component previously described above, and $R_{EQ}$, $R'_3$, and $G_1$ are given by the following equations:

$$R_{EQ}=(R_1+R_2+R_3)\|R_L\|rds_6 \tag{5}$$

$$R_3'=R_3\|(R_1+R_2) \tag{6}$$

$$G_1=g_{m1}(1+g_{m2}R_4)+g_{m2} \tag{7}$$

Furthermore, $g_{m1}$, $g_{m2}$, and $g_{m6}$ are given by the following equations:

$$g_{m1} = -\sqrt{\frac{2\mu_p C_{ox} I_{SD1} W_1}{L_1}} \tag{8}$$

$$g_{m2} = -\sqrt{\frac{2\mu_p C_{ox} I_{SD2} W_2}{L_2}} \tag{9}$$

$$g_{m6} = -\sqrt{\frac{2\mu_p C_{ox} I_{OUT} W_6}{L_6}} \tag{10}$$

where the "–" sign is due to the transistors $M_1$, $M_2$, and $M_6$ being PMOS transistors, $\mu_p$ represents the respective hole mobilities in the channels of the PMOS transistors $M_1$, $M_2$, and $M_6$, and $C_{ox}$ represents the respective unit-area capacitances of the gate oxides of these transistors.

And from equation (4), one can derive the following equations for the dominant pole $P_{DOMINANT}$, the output pole $P_{OUT}$, and the tracking zero $Z_{TRACK}$ of the LDO voltage regulator 50:

$$P_{DOMINANT} \approx \frac{1}{\beta_1 (g_{m6} R_{EQ} C_M) R_o} \tag{11}$$

$$P_{OUT} \approx -\frac{\beta_1}{(C_L + C_1)\left(\frac{1}{g_{m6}} \| \beta_1 R_{EQ}\right)} \tag{12}$$

$$Z_{TRACK} \approx -\frac{\left(g_{m1} + \frac{1}{R_4 + 1/g_{m2}}\right)}{C_M} \tag{13}$$

where $\beta_1$ is given by the following equation:

$$\beta_1 = \frac{R_3}{R_1 + R_2 + R_3} \tag{14}$$

At higher levels of the load current $I_{LOAD}$, $1/g_{m6} \ll \beta_1 \cdot R_{EQ}$; therefore, assuming that $C_L \gg C_1$ (this is a valid assumption in many applications, including an embodiment of the LDO voltage regulator 50), equation (12) reduces to:

$$P_{OUT} \approx -\frac{g_{m6}}{C_L} = \frac{1}{C_L}\sqrt{I_{OUT} * 2\mu C_{ox}\left[\frac{W_6}{L_6}\right]} \tag{15}$$

Similarly at higher levels of the load current $I_{LOAD}$, $$g_{m1} >> \frac{1}{R_4 + 1/g_{m2}}$$

such that equation (13) reduces to:

$$Z_{TRACK} \approx -\frac{g_{m1}}{C_M} = \frac{1}{C_M}\sqrt{I_{SD1} * 2\mu C_{ox}\left[\frac{W_1}{L_1}\right]} = \frac{1}{C_M}\sqrt{K_1 I_{OUT} * 2\mu C_{ox} K_2\left[\frac{W_6}{L_6}\right]} \tag{16}$$

where $$K_1 \cdot I_{OUT} = I_{SD1},$$

$$K_2\left[\frac{W_6}{L_6}\right] = \left[\frac{W_1}{L_1}\right],$$

$$K_1 < 1,$$

and $$K_2 < 1$$

Assuming that $C_M$ and $C_L$ are related by the following equation:

$$C_M = \alpha C_L \tag{17}$$

where $\alpha<1$ (this is a valid assumption in many applications, including an embodiment of the LDO voltage regulator 50), $Z_{TRACK}$ and $P_{OUT}$ are related by the following equation:

$$Z_{TRACK} \approx P_{OUT}\left[\frac{1}{\alpha}\sqrt{K_1 K_2}\right] \tag{18}$$

Consequently, by selecting appropriate values for $\alpha$, $K_1$, and $K_2$, a circuit designer can determine to what degree $Z_{TRACK}$ cancels $P_{OUT}$. For example, if the designer sets $$\frac{1}{\alpha}\sqrt{K_1 K_2} = 1,$$

then $Z_{TRACK}$ fully (or at least almost fully, taking into account the approximations made in the above equations, component error tolerances, etc.) cancels $P_{OUT}$. But in some applications, the designer may impart a better stability margin to the frequency response of the LDO voltage regulator 50 by setting $$\frac{1}{\alpha}\sqrt{K_1 K_2} \neq 1.$$

Furthermore, $V_{FB_TRACK}$ and $V_{OUT}$ are related by the following equation:

$$\frac{\text{VFB_TRACK}(S)}{VOUT(S)} = \frac{R_3[S(R_1 + R_2)C_1 + 1]}{(R_1 + R_2 + R_3)[SC_1(R_3 \| (R_1 + R_2)) + 1]} \tag{19}$$

And $V_{FB}$ and $V_{OUT}$ are related by the following equation:

$$\frac{VFB(S)}{VOUT(S)} = \frac{(R_2 + R_3)}{(R_1 + R_2 + R_3)} \frac{\frac{SC_1}{(1 + K_3)}\left[\begin{matrix}(R_3 \| (R_1 + R_2) + \\ (R_1 + R_2)K_3\end{matrix}\right] + 1}{[SC_1(R_3 \| (R_1 + R_2)) + 1]} \tag{20}$$

where $$K_3 = \frac{R_1 R_3}{(R_1 + R_2 + R_3)R_2}.$$

From equation (20), one can see that the capacitor $C_1$ generates a pole-zero pair, where the zero has a frequency that is lower than the frequency of the pole. If this pole-zero pair is located just outside of the open-loop unity-gain frequency of the LDO voltage regulator 50, then, at higher and full load currents $I_{LOAD}$, the LDO regulator may have a better margin of stability than if this pole-zero pair is located further away from the unity-gain frequency, or if the capacitor $C_1$ is omitted altogether from the LDO regulator.

Still referring to FIGS. 4 and 5, examples of values for at least some of the components of an embodiment of the LDO voltage regulator 50 are as follows for a range of $I_{LOAD}$ from about 0-10 mA ($g_{m1}$, $g_{m2}$, $g_{m6}$, $K_1$, and $K_2$ can be calculated from the below values and from the above equations):

$$R_1 = 2.0\ K\Omega$$

$$R_2 = 10.0\ K\Omega$$

$$R_3 = 8.0\ K\Omega$$

$$R_4 = 1.0\ K\Omega$$

$$C_M = 8.0\ \text{pF}$$

$$C_1 = 2.7\ \text{pF}$$

$$C_L = 0.0 - 100.0\ \text{pF}$$

$$\left[\frac{W_1}{L_1}\right] = 16 \cdot \frac{5.00\ \text{micrometers}(\mu\text{m})}{0.15\ \mu\text{m}}$$

$$\left[\frac{W_2}{L_2}\right] = 5 \cdot \frac{5.00\ \mu\text{m}}{0.15\ \mu\text{m}}$$

$$\left[\frac{W_3}{L_3}\right] = 5 \cdot \frac{10.00\ \mu\text{m}}{1.00\ \mu\text{m}}$$

$$\left[\frac{W_4}{L_4}\right] = 3 \cdot \frac{10.00\ \mu\text{m}}{1.00\ \mu\text{m}}$$

$$\left[\frac{W_5}{L_5}\right] = 26 \cdot \frac{1.35\ \mu\text{m}}{0.15\ \mu\text{m}}$$

-continued $$\left[\frac{W_6}{L_6}\right] = 45 \cdot \frac{60.00\ \mu m}{0.15\ \mu m}$$

Furthermore, alternate embodiments of the LDO voltage regulator 50 are contemplated. For example, the transistor $M_2$ may be omitted from the compensation circuit 56, and the resistor $R_4$ may be coupled directly to the node 66 or to ground; but the transistor $M_2$, when present, serves as a buffer that effectively causes $R_4$ to have little or no influence on the frequency of the output pole $P_{OUT}$. Furthermore, a dual of the LDO voltage regulator 50, where the PMOS transistors are replaced with NMOS transistors, may be designed according to the above-described techniques to generate a negative voltage level for $V_{OUT}$. Moreover, the resistor $R_2$ may be omitted from the voltage divider 60 such that $V_{FB}=V_{FB_TRACK}$.

Figure 8:
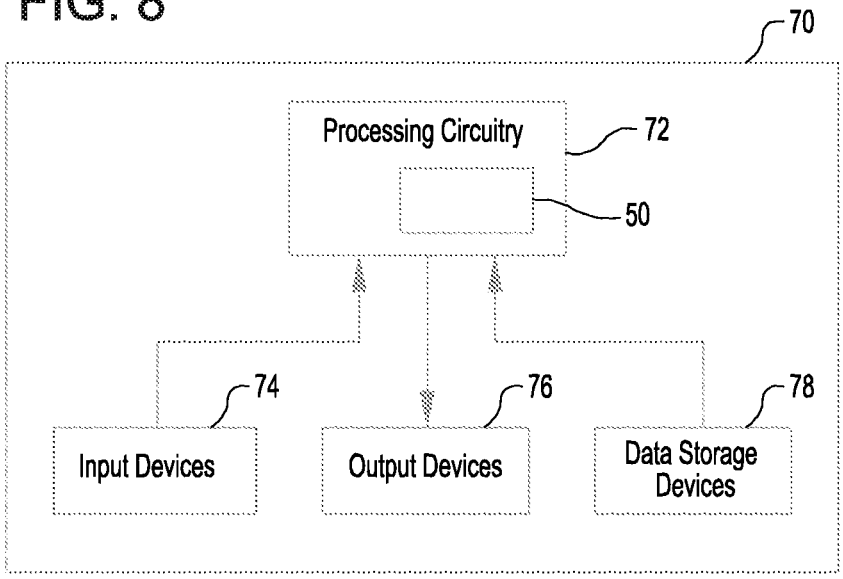
FIG. 8 is a diagram of a system that may incorporate the circuit of FIG. 3, for example, in the form of the LDO voltage regulator of FIG. 4, according to an embodiment.

FIG. 8 is a functional block diagram of an electronic system 70, which includes processing circuitry 72 containing one or more of the LDO voltage regulator 50 of FIGS. 4 and 5; for example, the processing circuitry may include the SOC 20 of FIG. 2 where the LDO voltage regulators 26 are each replaced by a respective LDO voltage regulator 50. The processing circuitry 72 includes circuitry for performing various functions, such as executing specific software to perform specific calculations, or controlling the system 70 to provide desired functionality. In addition, the electronic system 70 includes one or more input devices 74, such as a keyboard, mouse, touch screen, audible or voice-recognition component, and so on, coupled to the processing circuitry 72 to allow an operator to interface with the electronic system. Typically, the electronic system 70 also includes one or more output devices 76 coupled to the processing circuitry 72, where the output devices can include a printer, video display, audio output components, and so on. One or more data-storage devices 78 are also typically coupled to the processing circuitry 72 to store data or retrieve data from storage media (not shown). Examples of typical data storage devices 78 include magnetic disks, FLASH memory, other types of solid state memory, tape drives, optical disks like compact disks and digital versatile disks (DVDs), and so on.

From the foregoing it will be appreciated that, although specific embodiments have been described herein for purposes of illustration, various modifications may be made without deviating from the spirit and scope of the disclosure. Furthermore, where an alternative is disclosed for a particular embodiment, this alternative may also apply to other embodiments even if not specifically stated. Moreover, the components described above may be disposed on a single or multiple IC dies to form one or more ICs, these one or more ICs may be coupled to one or more other ICs. In addition, any described component or operation may be implemented/performed in hardware, software, firmware, or a combination of any two or more of hardware, software, and firmware. Furthermore, one or more components of a described apparatus or system may have been omitted from the description for clarity or another reason. Moreover, one or more components of a described apparatus or system that have been included in the description may be omitted from the apparatus or system.

What is claimed is:

1. An electronic circuit, comprising:

a feedback-coupled circuit stage including a drive circuit configured to drive a load, said drive circuit having a control input; and a compensation circuit stage coupled to the feedback-coupled stage;

wherein the compensation circuit stage comprises a capacitor coupled in series with a compensation transistor at the control input, said compensation transistor configured to exhibit a variable transconductance that is dependent on a voltage signal replicating voltage across the load and a current signal replicating current in the load.

2. The electronic circuit of claim 1 wherein the feedback-coupled circuit stage includes an amplifier.

3. The electronic circuit of claim 1 wherein the feedback-coupled circuit stage includes a voltage regulator.

4. The electronic circuit of claim 1 wherein the load includes an integrated circuit.

5. The electronic circuit of claim 1 wherein the load includes a computing circuit.

6. The electronic circuit of claim 1 wherein the load and the electronic circuit are disposed on a same integrated circuit die.

7. The electronic circuit of claim 1 wherein the load and the electronic circuit are disposed on respective integrated circuit dies.

8. The electronic circuit of claim 1 wherein the electronic circuit includes a low-drop-out voltage regulator.

9. The electronic circuit of claim 1 wherein the feedback-coupled circuit stage includes:

an input circuit stage configured to receive an input signal and a feedback signal and to generate an intermediate signal; and an output circuit stage including said drive circuit and configured to receive the intermediate signal, to generate the feedback signal, and to drive the load.

10. The electronic circuit of claim 1 wherein the feedback-coupled circuit stage includes:

an amplifier circuit stage configured to receive an input signal and a feedback signal and to generate an intermediate signal; and an output circuit stage including said drive circuit and configured to receive the intermediate signal, to generate the feedback signal, and to drive the load.

11. An electronic circuit, comprising:

a feedback-coupled circuit stage configured to drive a load; and a compensation circuit stage coupled to the feedback-coupled stage;

wherein a frequency response of a combination of the compensation circuit stage and feedback-coupled circuit stage includes a first root and an opposite second root that depend on the load;

wherein the feedback-coupled circuit includes an intermediate node, and wherein the compensation circuit stage comprises:

a first input configured to receive an intermediate signal from the intermediate node of the feedback-coupled circuit stage;

a second input configured to receive a current signal replicating current in the load;

a third input configured to receive a voltage signal replicating voltage across the load;

a variable resistance biased by the intermediate signal and the current signal, said variable resistance controlled by said voltage signal.

12. The electronic circuit of claim 11 wherein:

the first root includes a first pole;

the second root includes a zero; and the frequency response includes a third root that includes a dominant second pole.

13. The electronic circuit of claim 11 wherein the first root includes a pole.

14. The electronic circuit of claim 11 wherein the second root includes a zero.

15. The electronic circuit of claim 11 wherein the second root is approximately equal to a product of the first root and a constant.

16. The electronic circuit of claim 11 wherein the frequency response includes a third root that is lower than the first and second roots.

17. The electronic circuit of claim 11, further comprising a capacitor coupled between the first and second inputs and in series with the variable resistance.

18. The electronic circuit of claim 11 wherein the variable resistance comprises a transistor having a control terminal coupled to receive the voltage signal and a conduction terminal coupled to receive the intermediate and current signals.

19. The electronic circuit of claim 18 wherein the transistor has a transconductance that varies in response to the current and voltage signals.

20. An electronic circuit comprising:

a feedback-coupled circuit stage configured to drive a load; and a compensation circuit stage coupled to the feedback-coupled stage;

wherein the compensation circuit stage comprises:

a current sensing circuit coupled to sense current in the load and generate a current signal applied to a first node;

a capacitor coupled between an intermediate node of the feedback-coupled circuit and the first node;

a voltage sensing circuit coupled to sense voltage in the load and generate a voltage signal;

a first transistor having a source-drain path coupled between the first node and a reference node;

a resistor coupled between the first node and a second node; and a second transistor having a source-drain path coupled between the second node and the reference node;

wherein gate terminals of the first and second transistors are coupled to receive the voltage signal.

* * * * *

UNITED STATES PATENT AND TRADEMARK OFFICE

CERTIFICATE OF CORRECTION

PATENT NO. : 9,256,233 B2
APPLICATION NO. : 13/915828
DATED : February 9, 2016
INVENTOR(S) : Pralay Mandal et al.

It is certified that error appears in the above-identified patent and that said Letters Patent is hereby corrected as shown below:

Title Page, item (54) and in the Specification, Column 1, lines 1-4,

The Title of the Invention should read:

GENERATING A ROOT OF AN OPEN-LOOP FREQUENCY RESPONSE THAT TRACKS AN OPPOSITE ROOT OF THE FREQUENCY RESPONSE

Signed and Sealed this
Twenty-sixth Day of July, 2016

Michelle K. Lee

Michelle K. Lee
*Director of the United States Patent and Trademark Office*